US007828398B1

(12) United States Patent
Burnick et al.

(10) Patent No.: US 7,828,398 B1
(45) Date of Patent: Nov. 9, 2010

(54) ENCLOSED MOBILE BAR APPARATUS

(76) Inventors: Robert P. Burnick, 491 SE. Volkerts Ter., Port Saint Lucie, FL (US) 34983; Matilde Burnick, 491 SE. Volkerts Ter., Port Saint Lucie, FL (US) 34983

( * ) Notice: Subject to any disclaimer, the term of this patent is extended or adjusted under 35 U.S.C. 154(b) by 0 days.

(21) Appl. No.: 12/727,421

(22) Filed: Mar. 19, 2010

(51) Int. Cl.
*A47B 96/00* (2006.01)

(52) U.S. Cl. ..... 312/140.2; 312/225; 312/351

(58) Field of Classification Search ..... 312/224–227, 312/140.1–140.4, 348.3, 249.11, 249.9, 282, 312/330.1, 351
See application file for complete search history.

(56) References Cited

U.S. PATENT DOCUMENTS

| | | | | | |
|---|---|---|---|---|---|
| 122,337 | A | * | 1/1872 | Thompson | 312/224 |
| 815,592 | A | * | 3/1906 | Karlson | 312/307 |
| 1,066,006 | A | * | 7/1913 | Forgy | 312/210.5 |
| 1,094,397 | A | * | 4/1914 | Abbath | 312/351 |
| 1,179,017 | A | * | 4/1916 | McVicker | 312/289 |
| 1,419,481 | A | * | 6/1922 | Williams | 312/224 |
| 1,929,063 | A | * | 10/1933 | Hampton | 312/107 |
| 1,944,405 | A | * | 1/1934 | Krause | 312/140.2 |
| 2,141,468 | A | * | 12/1938 | Hamaker | 312/140.2 |
| 2,143,239 | A | * | 1/1939 | Foltz | 62/384 |
| 2,344,800 | A | * | 3/1944 | Butcher | 312/274 |
| 2,488,035 | A | * | 11/1949 | Pistone | 312/204 |
| D256,639 | S | | 9/1980 | Lee, III et al. | |
| 4,460,221 | A | * | 7/1984 | Dimino | 312/277 |
| 5,020,867 | A | | 6/1991 | McManus | |
| 5,251,790 | A | | 10/1993 | Cohn et al. | |
| 6,443,542 | B1 | | 9/2002 | Lindquist et al. | |
| 6,840,592 | B2 | * | 1/2005 | Kalieta et al. | 312/326 |
| 7,131,545 | B1 | * | 11/2006 | Grogan | 211/85.29 |
| 7,261,384 | B1 | * | 8/2007 | Craft et al. | 312/235.3 |
| 7,338,139 | B2 | * | 3/2008 | Peter | 312/107 |
| D594,671 | S | | 6/2009 | Brandon | |

* cited by examiner

*Primary Examiner*—Janet M Wilkens
(74) *Attorney, Agent, or Firm*—Crossley Patent Law; Mark A. Crossley

(57) ABSTRACT

The enclosed mobile bar apparatus providing a decorative encasement and having a depth of about 26 inches and a height of about 73 inches to provide ample storage and ease of mobility through any standard doorway. The retractable pull-out table with barrier provides a work surface that can be extended forwardly from the encasement and retracted within, then hidden by the doors. The doors are equipped with pane inserts providing further decorative appeal. Stemware racks from within the top downwardly are arranged side by side. The mezzanines importantly increase storage capabilities of the encasement but also, by their substantial u-shape, allow for unfenced storage on the pullout table. The mezzanines also importantly provide decorative flair to the encasement interior, along with decorative barriers. The mezzanines may be identically shaped and sized. Horizontally disposed bottle racks may be provided in either the upper or lower drawer or both.

3 Claims, 6 Drawing Sheets

ENCLOSED MOBILE BAR APPARATUS

BACKGROUND OF THE INVENTION

Various bars and mobile bars have existed for years. Many bars are comprised of bar tops with rearwardly concealed shelving, appliance, and storage areas. Some mobile bars are small and include minimal storage and presentation capabilities. What has been needed is a mobile furniture item that externally appears as do most chests and chests with drawers, wherein a user can open the fully enclosed apparatus to access substantially complete and decorative storage within. Storage within should also secure items against their being easily dislodged. The present apparatus provides for these needs.

FIELD OF THE INVENTION

The enclosed mobile bar apparatus relates to furniture items and more especially to an enclosed mobile furniture item that comprises a bar.

SUMMARY OF THE INVENTION

The general purpose of the enclosed mobile bar apparatus, described subsequently in greater detail, is to provide a enclosed mobile bar apparatus which has many novel features that result in an improved enclosed mobile bar apparatus which is not anticipated, rendered obvious, suggested, or even implied by prior art, either alone or in combination thereof.

To attain this, the enclosed mobile bar apparatus comprises an encasement that appears as do many typical furniture items with doors and drawers and the like. The apparatus importantly provides mobility via two means, handles and casters. The handles are importantly extended outwardly from the encasement sides. Of further importance is that the handles are supported by spaced apart handle supports, with each side having a handle support adjacent to the front and a handle support adjacent to the back, with the rounded handle connecting each side's pair of supports. Importantly, the apparatus has a depth of about 26 inches and a height of about 73 inches, thereby providing ample storage and ease of mobility through any standard doorway.

The retractable pull-out table with barrier provides a work surface that can be extended forwardly from the encasement and retracted within, then hidden by the doors. The doors are equipped with pane inserts, of various materials which may include glass and mirrors, while provided further decorative appeal.

The stemware racks are disposed from within the top and are arranged side by side. The rounded fronts of the stemware racks aid the entry of the stems of wine glasses and the like and assist against stemware breakage.

The mezzanines importantly increase storage capabilities of the encasement but also, by their substantial u-shape, allow for unfenced storage on the pullout table. The mezzanines also importantly provide decorative flair to the encasement interior, along with decorative barriers. The mezzanines may be identically shaped and sized. Bottle racks may be provided in either the upper or lower drawer or both. The bottle racks provide for proper wine storage.

Thus has been broadly outlined the more important features of the improved enclosed mobile bar apparatus so that the detailed description thereof that follows may be better understood and in order that the present contribution to the art may be better appreciated.

An object of the enclosed mobile bar apparatus is to provide an enclosed portable bar.

Another object of the enclosed mobile bar apparatus is to provide a portable bar that externally resembles other furniture items.

A further object of the enclosed mobile bar apparatus is to provide a decorative interior.

An added object of the enclosed mobile bar apparatus is to provide ample storage for beverages.

And, an object of the enclosed mobile bar apparatus is to provide ample, accessible storage for glassware.

Yet another object of the enclosed mobile bar apparatus is to provide a retractable working surface.

Still another object of the enclosed mobile bar apparatus is to provide for transport through standard doorways.

These together with additional objects, features and advantages of the improved enclosed mobile bar apparatus will be readily apparent to those of ordinary skill in the art upon reading the following detailed description of presently preferred, but nonetheless illustrative, embodiments of the improved enclosed mobile bar apparatus when taken in conjunction with the accompanying drawings.

In this respect, before explaining the current embodiments of the improved enclosed mobile bar apparatus in detail, it is to be understood that the enclosed mobile bar apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved enclosed mobile bar apparatus. It is therefore important that the claims be regarded as including such equivalent constructions insofar as they do not depart from the spirit and scope of the enclosed mobile bar apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the enclosed mobile bar apparatus generally designated by the reference number 10 will be described.

Figure 1:
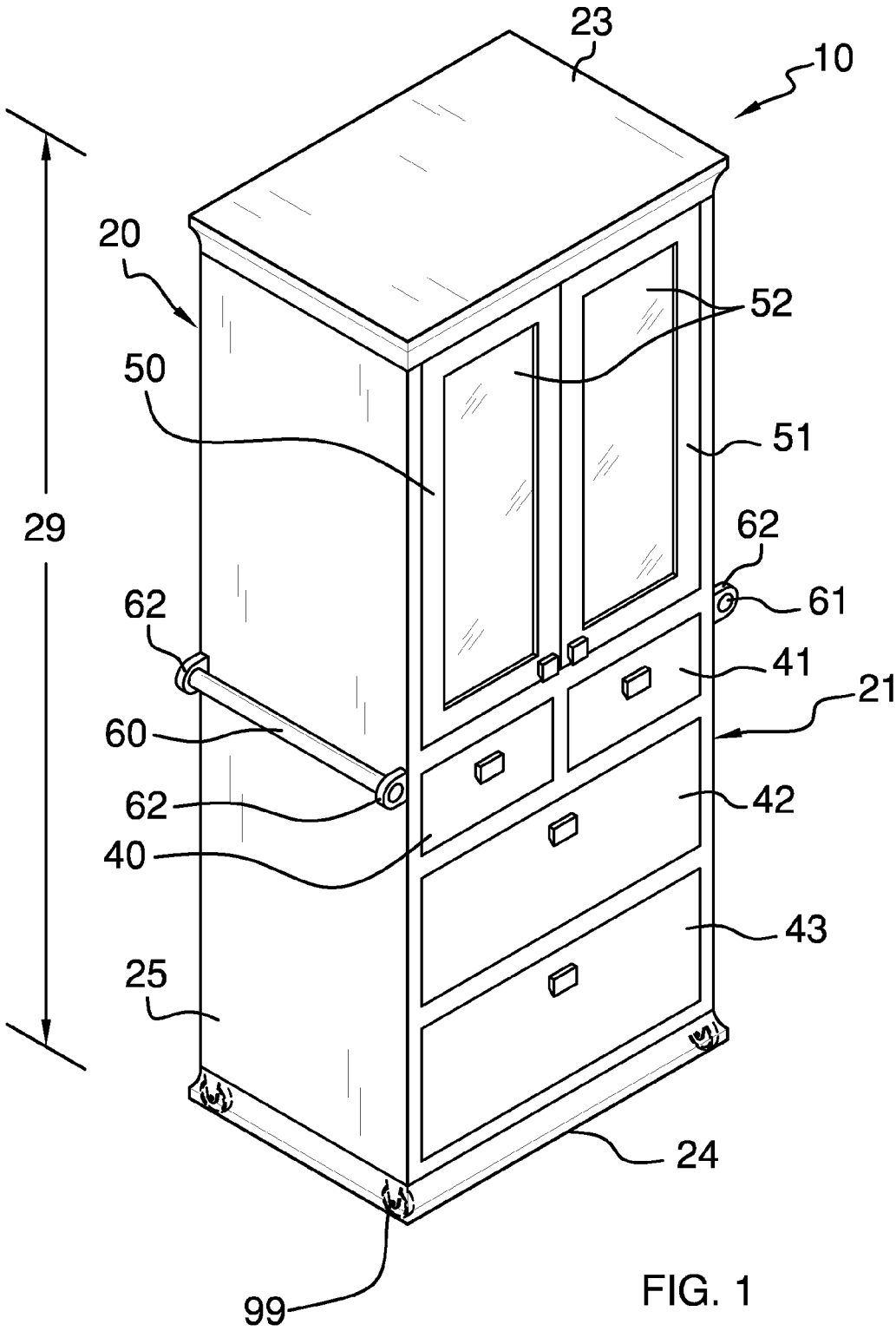
FIG. 1 is a front perspective view.

Referring to FIG. 1, the apparatus 10 partially comprises a front 21 spaced apart from a back 22 and a top 23 spaced apart from a bottom 24.

Figure 3:
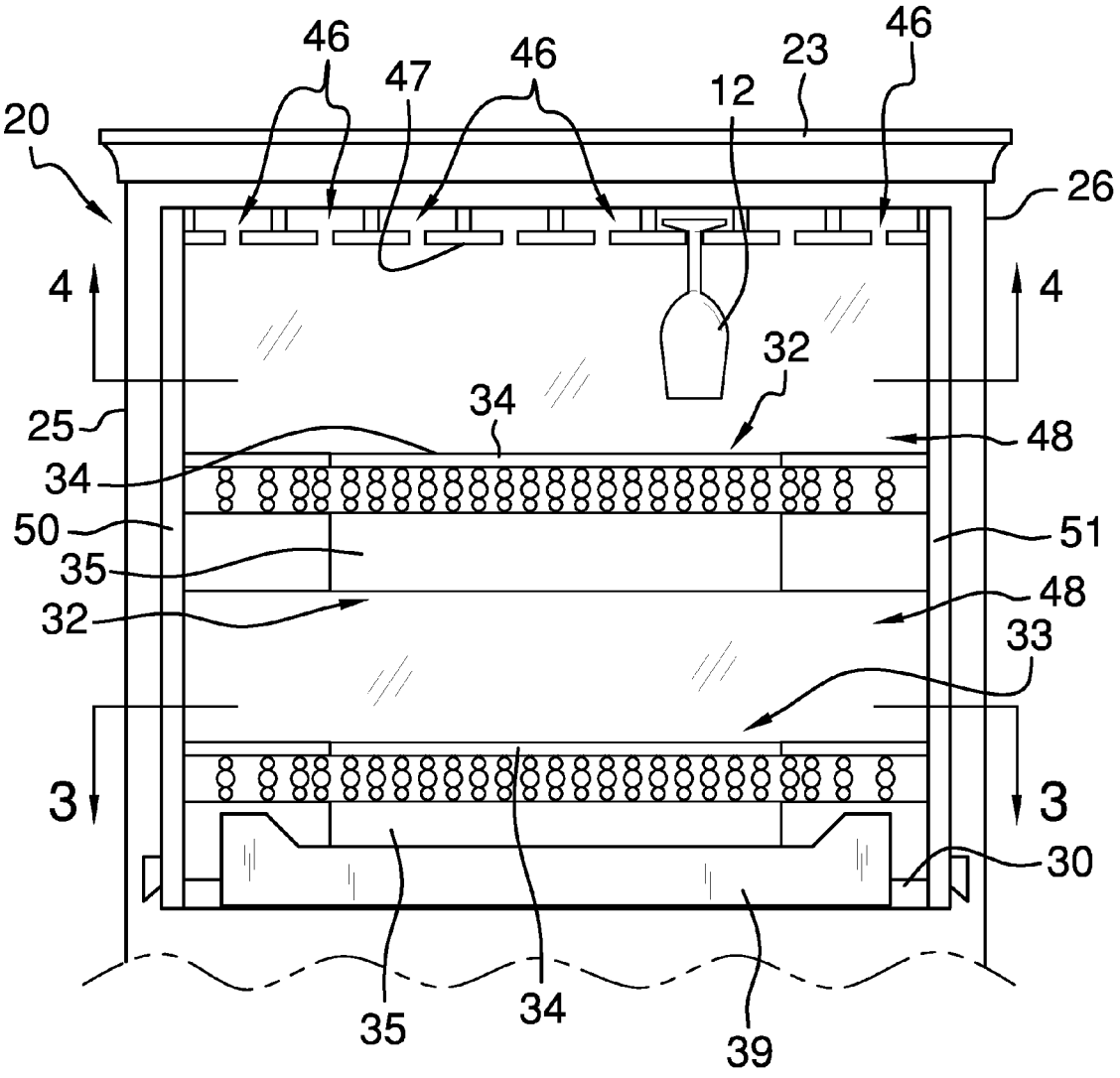
FIG. 3 is a front elevation view of the apparatus, above the drawers.

Referring to FIG. 3, the first side 25 is spaced apart from the second side 26. The horizontal floor 30 is disposed about midway between the top 23 and the bottom 24.

Figure 4:
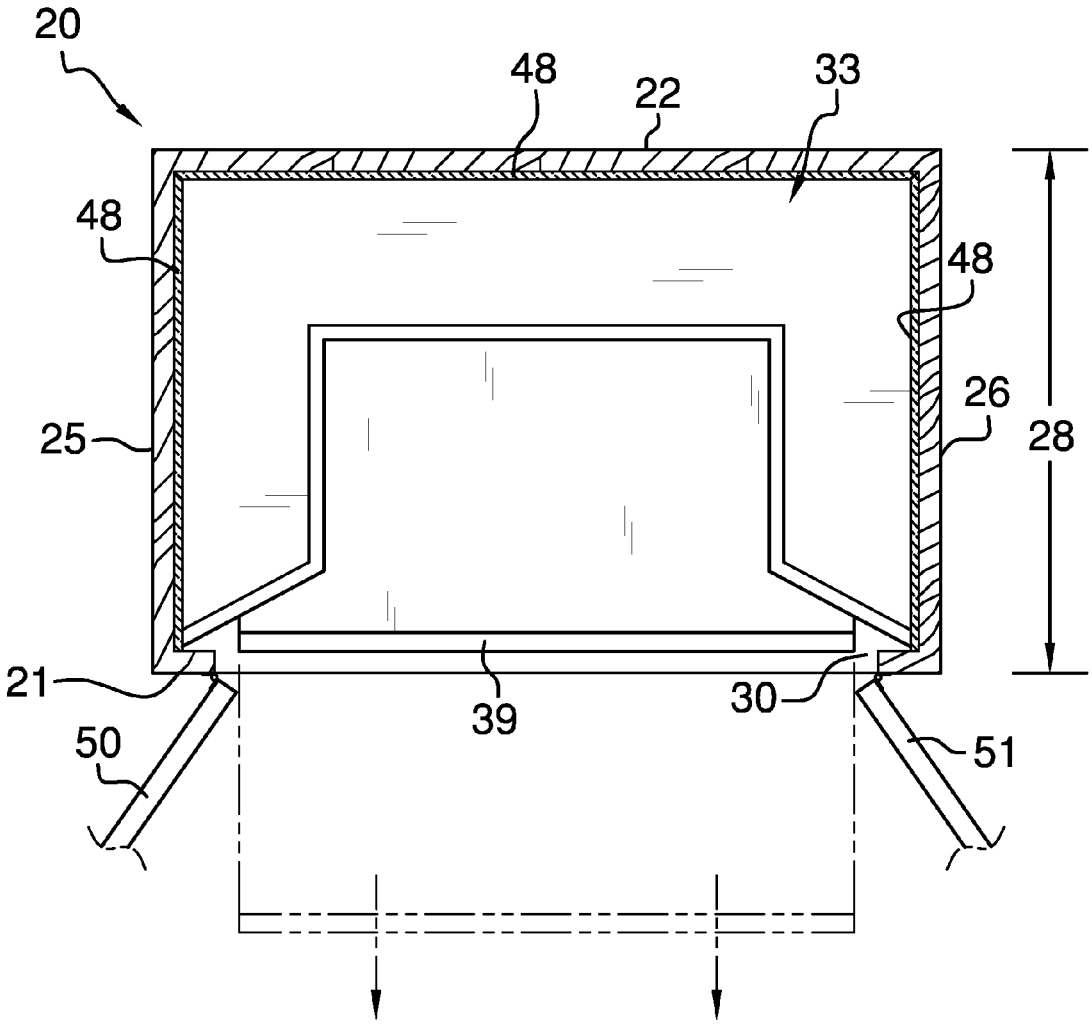
FIG. 4 is a cross sectional view of FIG. 3, taken along the line 4-4.

Referring to FIG. 4, the pull-out table with barrier 39 is disposed atop the floor 30. A mirror 48 is disposed within the back 22 between the first side 25 and the second side 26, and between the top 23 and the floor 30.

A mirror 48 is disposed within the first side 25 between the front 21 and the back 22, and between the top 23 and the floor 30. A mirror 48 is disposed within the second side 26 between the front 21 and the back 22, and between the top 23 and the floor 30.

Figure 5:
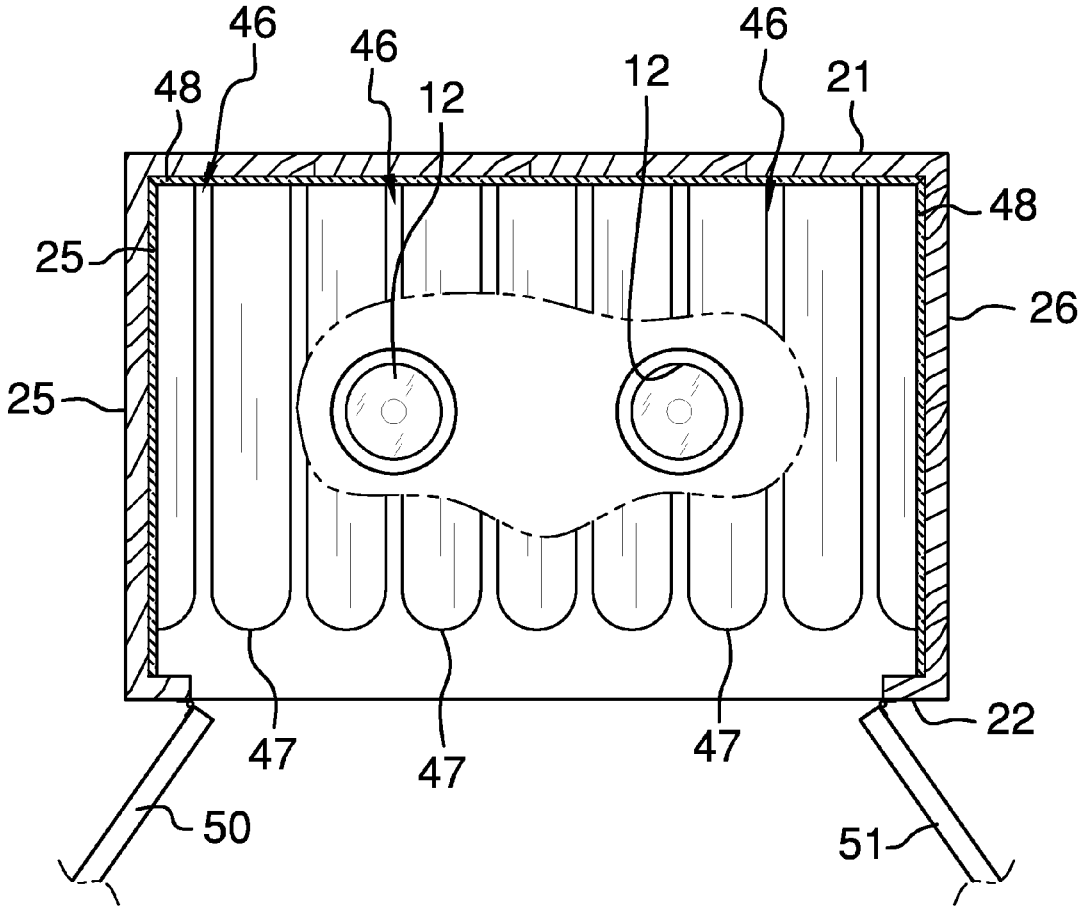
FIG. 5 is a cross sectional view of FIG. 3, taken along the line 5-5.

Referring to FIG. 5, the plurality of stemware racks 46 is disposed downwardly from the top 23 within the encasement 20. The stemware racks 46 are disposed side by side from proximal to the front 21 to the back 22. Each stemware rack 46 has a forwardly disposed rounded front 47 which receives stemware 12.

Referring again to FIGS. 3 and 4, the second mezzanine 33 is disposed above and proximal to the floor 30 and the pull-out table with barrier 39.

Referring to FIG. 2 and again to FIG. 3, the first mezzanine 32 is disposed above the second mezzanine 33. The first mezzanine 32 is disposed between the second mezzanine 33 and the top 23. Each substantially u-shaped mezzanine further comprises a lateral center barrier 35. A pair of spaced apart forwardly faced barriers 36 is connected to the lateral center barrier 35. A pair of spaced apart slanted barriers 37 is connected to one of each of the ends of the lateral center barriers 35. An outer lateral barrier 38 connects each slanted barrier 37 to one of the sides of the encasement 20. Each mezzanine is thereby importantly supported by the back 22, the first side 25, and the second side 26. A continual decorative railing 34 is affixed inwardly and atop each barrier.

Figure 2:
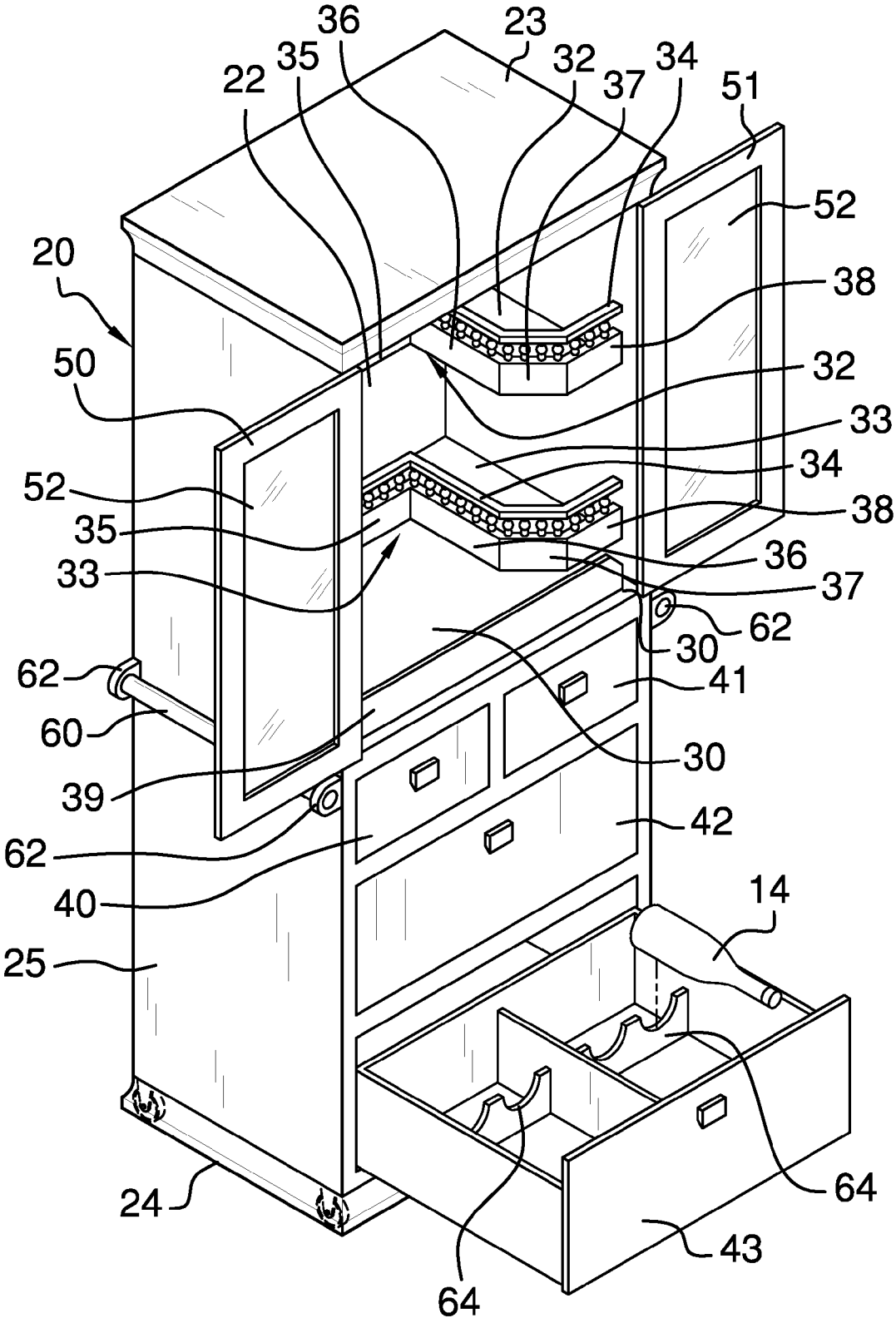
FIG. 2 is a front perspective view, doors and lower drawer open.

Referring to FIG. 2, the pair of centrally opened hinged doors is disposed on the encasement 20 front 21 between the top 23 and the floor 30. An inset pane 52 is disposed within each door. The doors comprise the first hinged door 50 and the second hinged door 51.

Referring to FIGS. 1 and 2, a plurality of drawers is disposed within and accessible from the encasement 20 front 21, below the floor 30. The drawers partially comprise the pair of half drawers disposed between the first side 25 and the second side 26. The half drawers comprise the first half drawer 40 positioned beside the second half drawer 41. The upper drawer 42 is disposed below the half drawers. The lower drawer 43 is disposed between the upper drawer 42 and the encasement 20 bottom 24. The pair of bottle racks 64 is disposed side by side within the lower drawer 43, the racks 64 removably holding bottles 14. A pair of casters 99 is disposed downwardly on the encasement 20 bottom 24 near each of the first side 25 and the second side 26 and is hidden within the encasement.

Figure 6:
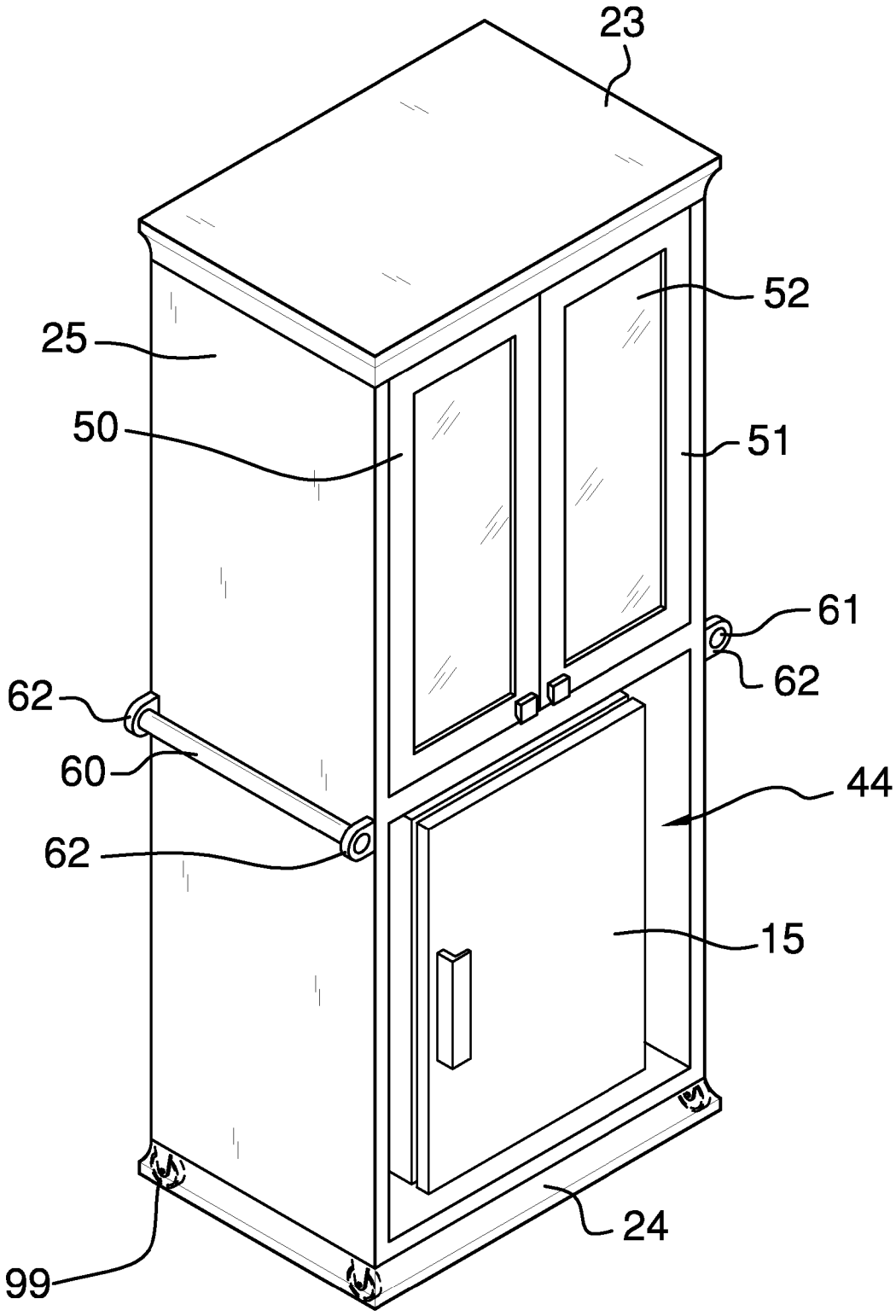
FIG. 6 is a perspective view of apparatus that negates the drawers.

Referring to FIG. 6, the apparatus 10 is also available without drawers and with, instead, a front accessible compartment 44 disposed within the encasement 20 below the floor 30. The compartment 44 holds such items as a refrigerator 15.

Referring again to FIG. 1, the encasement 20 further comprises a pair of identical handles comprising a first handle 60 attached to the first side 25 via a pair of spaced apart handle supports 62, one of each of the handle supports 62 affixed adjacent to the front 21, one of each of the handle supports 62 affixed adjacent to the back 22, a second handle 61 affixed to the second side 26 via a pair of spaced apart handle supports 62, one of each of the handle supports 62 affixed adjacent to the front 21, one of each of the handle supports 62 affixed adjacent to the back 22.

With respect to the above description then, it is to be realized that the optimum dimensional relationships for the parts of the enclosed mobile bar apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the enclosed mobile bar apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the enclosed mobile bar apparatus may be used.

Therefore, the foregoing is considered as illustrative only of the principles of the enclosed mobile bar apparatus. Further, since numerous modifications and changes will readily occur to those skilled in the art, it is not desired to limit the enclosed mobile bar apparatus to the exact construction and operation shown and described, and accordingly, all suitable modifications and equivalents may be resorted to, falling within the scope of the enclosed mobile bar apparatus.

What is claimed is:

1. An enclosed mobile bar apparatus comprising, in combination:

an encasement having a front spaced apart from a back, a top spaced apart from a bottom, and a first side spaced apart from a second side;

a horizontal floor disposed about midway between the top and the bottom;

a pull-out table with barrier disposed atop the floor;

a mirror disposed within the back between the first side and the second side, between the top and the floor;

a mirror disposed within the first side between the front and the back, between the top and the floor;

a mirror disposed within the second side between the front and the back, between the top and the floor;

a plurality of stemware racks disposed downwardly from the top within the encasement, the stemware racks disposed side by side from proximal to the front to the back, each stemware rack having a forwardly disposed rounded front;

a second mezzanine disposed above and proximal to the floor and the pull-out table with barrier;

a first mezzanine disposed above the second mezzanine, the first mezzanine disposed between the second mezzanine and the top;

each mezzanine further comprising:

a lateral center barrier;

a pair of spaced apart forwardly faced barriers connected to the lateral center barrier;

a pair of spaced apart slanted barriers, one of each of the slanted barriers connected to one of each of the forwardly faced barriers;

an outer lateral barrier connecting each slanted barrier to one of the sides of the encasement;

whereby each mezzanine is supported by the back, the first side, and the second side;

a continual decorative railing affixed inwardly and atop each barrier;

a pair of centrally opened hinged doors disposed on the encasement front between the top and the floor;

an inset pane within each door;

a plurality of drawers disposed within and accessible from the encasement front, below the floor, the drawers comprising:

a pair of half drawers disposed between the first side and the second side, the half drawers comprising a first half drawer beside a second half drawer;

an upper drawer disposed below the half drawers;

a lower drawer disposed between the upper drawer and the encasement bottom;

a pair of bottle racks disposed side by side within the lower drawer;

a pair of casters downwardly disposed on the encasement bottom near each of the first side and the second side, the casters hidden within the encasement from external viewing.

2. An enclosed mobile bar apparatus comprising, in combination:

a height of about 73 inches;

a depth of about 26 inches;

an encasement having a front spaced apart from a back, a top spaced apart from a bottom, and a first side spaced apart from a second side;

a horizontal floor disposed about midway between the top and the bottom;

a pull-out table with barrier disposed atop the floor;

a mirror disposed within the back between the first side and the second side, between the top and the floor;

a mirror disposed within the first side between the front and the back, between the top and the floor;

a mirror disposed within the second side between the front and the back, between the top and the floor;

a plurality of stemware racks disposed downwardly from the top within the encasement, the stemware racks disposed side by side from proximal to the front to the back, each stemware rack having a forwardly disposed rounded front;

a second mezzanine disposed above and proximal to the floor and the pull-out table with barrier;

a first mezzanine disposed above the second mezzanine, the first mezzanine disposed between the second mezzanine and the top;

each mezzanine further comprising:

a lateral center barrier;

a pair of spaced apart forwardly faced barriers connected to the lateral center barrier;

a pair of spaced apart slanted barriers, one of each of the slanted barriers connected to one of each of the forwardly faced barriers;

an outer lateral barrier connecting each slanted barrier to one of the sides of the encasement;

whereby each mezzanine is supported by the back, the first side, and the second side;

a continual decorative railing affixed inwardly and atop each barrier;

a pair of centrally opened hinged doors disposed on the encasement front between the top and the floor;

an inset pane within each door;

a plurality of drawers disposed within and accessible from the encasement front, below the floor, the drawers comprising:

a pair of half drawers disposed between the first side and the second side, the half drawers comprising a first half drawer beside a second half drawer;

an upper drawer disposed below the half drawers;

a lower drawer disposed between the upper drawer and the encasement bottom;

a pair of bottle racks disposed side by side within the lower drawer;

a pair of casters downwardly disposed downwardly on the encasement bottom near each of the first side and the second side, the casters hidden within the encasement from external viewing;

a pair of identical handles comprising a first handle attached to the first side via a pair of spaced apart handle supports, one of each of the handle supports affixed adjacent to the front, one of each of the handle supports affixed adjacent to the back, a second handle affixed to the second side via a pair of spaced apart handle supports, one of each of the handle supports affixed adjacent to the front, one of each of the handle supports affixed adjacent to the back.

3. An enclosed mobile bar apparatus comprising, in combination:

a height of about 73 inches;

a depth of about 26 inches;

an encasement having a front spaced apart from a back, a top spaced apart from a bottom, and a first side spaced apart from a second side;

a horizontal floor disposed about midway between the top and the bottom;

a pull-out table with barrier disposed atop the floor;

a mirror disposed within the back between the first side and the second side, between the top and the floor;

a mirror disposed within the first side between the front and the back, between the top and the floor;

a mirror disposed within the second side between the front and the back, between the top and the floor;

a plurality of stemware racks disposed downwardly from the top within the encasement, the stemware racks disposed side by side from proximal to the front to the back, each stemware rack having a forwardly disposed rounded front;

a second mezzanine disposed above and proximal to the floor and the pull-out table with barrier;

a first mezzanine disposed above the second mezzanine, the first mezzanine disposed between the second mezzanine and the top;

each mezzanine further comprising:

a lateral center barrier;

a pair of spaced apart forwardly faced barriers connected to the lateral center barrier;

a pair of spaced apart slanted barriers, one of each of the slanted barriers connected to one of each of the forwardly faced barriers;

an outer lateral barrier connecting each slanted barrier to one of the sides of the encasement;

whereby each mezzanine is supported by the back, the first side, and the second side;

a continual decorative railing affixed inwardly and atop each barrier;

a pair of centrally opened hinged doors disposed on the encasement front between the top and the floor;

an inset pane within each door;

a front accessible compartment disposed within the encasement below the floor;

a pair of casters downwardly disposed on the encasement bottom near each of the first side and the second side, the casters hidden within the encasement from external viewing;

a pair of identical handles comprising a first handle attached to the first side via a pair of spaced apart handle supports, one of each of the handle supports affixed adjacent to the front, one of each of the handle supports affixed adjacent to the back, a second handle affixed to the second side via a pair of spaced apart handle supports, one of each of the handle supports affixed adjacent to the front, one of each of the handle supports affixed adjacent to the back.

* * * * *